United States Patent [19]

Lapertosa

[11] Patent Number: 4,571,109

[45] Date of Patent: Feb. 18, 1986

[54] LOOSELEAF NOTEBOOK ARRANGEMENT

[75] Inventor: Samuel P. Lapertosa, Hinsdale, Ill.

[73] Assignee: Sales Tools, Inc., Des Plaines, Ill.

[21] Appl. No.: 577,198

[22] Filed: Feb. 6, 1984

[51] Int. Cl.[4] ..... B42F 13/00; B42F 3/04; B42F 13/06

[52] U.S. Cl. ..... 402/77; 402/31; 402/15

[58] Field of Search ..... 402/15, 75, 76, 77, 402/78, 31; 281/30, 31, 32; D3/71; 434/248

[56] References Cited

U.S. PATENT DOCUMENTS

| | | | |
|---|---|---|---|
| D. 275,152 | 8/1984 | Gerch | D3/71 |
| 687,941 | 12/1901 | Radford et al. . | |
| 1,551,044 | 8/1925 | Mullins | 402/77 |
| 1,980,630 | 11/1934 | Otto | 129/23 |
| 2,637,323 | 5/1953 | Lockwood | 402/77 |
| 3,260,264 | 7/1966 | McKowen | 129/23 |
| 3,574,472 | 4/1971 | Cott | 402/77 |
| 4,129,212 | 12/1978 | Hopkins | 402/77 |
| 4,239,411 | 12/1980 | Moliard | 402/77 |
| 4,340,316 | 7/1982 | Jahn | 402/68 |
| 4,465,305 | 8/1984 | Bateman et al. | 281/31 |
| 4,470,620 | 9/1984 | Gerch | 281/31 |

FOREIGN PATENT DOCUMENTS

| | | | |
|---|---|---|---|
| 7364 | of 1884 | United Kingdom | 402/15 |

*Primary Examiner*—Paul A. Bell

*Assistant Examiner*—Paul M. Heyrana, Sr.

*Attorney, Agent, or Firm*—McWilliams, Mann, Zummer and Sweeney

[57] ABSTRACT

A low profile notebook for holding looseleaf style prepunched notebook paper of the inexpensive lined or blank type commonly used in schools of all levels by students for note taking purposes, in which the notebook comprises front and rear panels articulated to a back panel, with a one piece all plastic notebook paper binder being anchored to the rear panel adjacent and parallel to the back panel and comprising a back piece having a pair of spaced upstanding rectilinear posts adjacent either end of same that are positioned as applied to the notebook to be received in several of the prepunched holes in the paper, and an end flange upstanding from each end of the back piece, with each end flange having a flap articulated to same that is adapted to swing substantially in coplanar relation with the plane of the paper mounting posts to move toward and away from the post adjacent same and each having a snap fit locking means for snap fit locking engagement with the respective posts to releasably bind the paper in the notebook looseleaf fashion, with the front panel of the notebook on its outer surfacing having a transparent marginal pocket adjacent the notebook back panel for mounting one or several sheets of the paper on the front panel of the notebook clipboard style, for note taking purposes.

6 Claims, 8 Drawing Figures

LOOSELEAF NOTEBOOK ARRANGEMENT

This invention relates to looseleaf notebooks and more particularly, to notebooks or binders especially suited for removably mounting or binding in the notebook the common type of inexpensive prepunched (lined or unlined) notebook paper that is widely used in schools at all levels by students for note taking purposes.

It has been common practice for discount merchandisers and others distributing school supplies to offer for student purchase inexpensive lined or unlined notebook paper in binder-free, pad or package form, of which each pad or package has a predetermined number of sheets (for instance, fifty sheets), with the sheets of the pads or packages being prepunched at identical predetermined locations to define notebook binding holes at standard locations to receive the prongs of notebook metals to mount such paper in one of the many types and styles of looseleaf notebooks that are separately available for this purpose. The binder metals of such notebooks are commonly equipped with sets of cooperating binding ring prongs for removably binding the paper in the notebook in the familiar looseleaf style, with the ring prong sets for particular metals varying in number from three to five or more depending on the length dimension of the sheets involved. The commonly used and available eight and one-half inch by eleven inch lined notebook paper, for instance, is normally provided with three holes along the left hand margin of the paper, with a spacing of four and one-quarter inches between the holes, thereby accommodating such paper to be applied to the common three ring binder notebook of which the binder is made up of three sets of the indicated ring prongs. However, similar paper of other sizes may include additional prepunched border openings at different spacings along the paper left hand margin, but lined up with the three ring binder receiving prepunched holes for accommodating application of such paper to varient forms of binders.

Ring binder notebooks of the type indicated include the familiar ring prong metal mechanism that normally has the binding rings arranged in spaced sets of three or more, each set of which comprises arcuate or curved opposed prongs that close to the familiar ring configuration through the similarly located paper prepunched holes to bind the paper into the notebook, which ring binder sets open to either side of the notebook to permit removal and/or insertion of one or more of the paper sheets. The metal involved in such notebooks is ordinarily suitably anchored to the spine or back panel of the notebook, with the notebook rear panel and front panel being articulated to the back panel to close over the notebook paper in the well known book like manner when the notebook is closed.

Notebooks that are equipped with the opening and closing ring prong type of ring binder mechanisms commonly require that the back panel to which the metal mechanism is fixed be of a width dimension that does not permit the notebook to lie flat when it is closed, unless it has enough looseleaf paper bound in its binder to sufficiently fill the binder rings so that the front and rear panels are in substantial parallelism. While under such circumstances the notebook may lie flat, it is bulky, does not have a low profile, and is difficult to handle to both remove and add papers. When such binders have only enough paper bound in them to be easy to handle, the notebook has the familiar wedge shaped configuration when closed of which the back panel width and binder mechanism of the notebook significantly exceeds the spacing of the front and rear panels at their free edges in the closed position of the notebook. Here again, such binders lack a desirable low profile for carrying and storage purposes.

Further, the sets of prongs of ring binders commonly close under spring biasing (tensioning of the hook plate metal) that is generated by the opening of the prongs, and since the prongs are formed from metal, their operation on closure is noisy. When a number of such binders are opened and closed at the same time in a classroom, the resulting noises are a clatter that is all too frequently of a class disrupting nature.

Another common form of notebook used by students for note taking purposes is the familiar spiral coil binder notebook which presents the familiar difficulties that the paper involved is available only with the well known front and back covers and the spiral wire binder applied to same; for removal purposes the individual sheets of paper are torn out of the binder and cannot be bound back into the binder, and it is not practical for the student to try to add new paper sheets to such binders. Further, such binders are of value to the student only during the quarter or semester in which it is used; any left over unused paper of the binder is lost as the entire binder must ordinarily be replaced for note taking during each subsequent school term.

Moreover, the spiral wire binder device of such binders is exposed along the bound edges of the paper and front and rear covers, and while notebooks of this type may lie flat, the spiral wire binder component of same, having to be exposed in oversize to convolutely mount the notebook paper and front and rear covers, has a cross diameter that is larger than the thickness of notebook, and the coils of the binder device are fully exposed to catch in clothing or the like, and interfere with each other when such notebooks are stacked together for merchandising display, transportation or storage. Thus, such notebooks likewise do not really have the desired low profile.

It will thus be seen that the commonly available ring prong type binder notebook and the spiral ring binder notebook present handling, carrying, and storage problems for students. Where the widely popular and inexpensive prepunched and unbound lined notebook paper is to be employed, as has become increasingly popular with students for cost saving purposes, the spiral binder notebook can't be used, and the conventional locking prong type ring binders are overly bulky when closed and thus can be difficult to carry, stack, or pack away when closed, and they are noisy in operation as the prong rings are open and closed to add or remove paper therefrom.

A principal object of this invention is to provide a notebook arrangement of the looseleaf binder type that is especially suited for student use of the inexpensive prepunched lined or ruled notebook paper that is inexpensively available in multiple sheet pad or package form, with the notebook and its binder readily accommodating opening and closing of same to bind in or release one or more sheets of the notebook paper, as needed, and with essentially silent or noiseless operating action.

Another principal object of the invention is to provide a notebook of the looseleaf binder type that avoids the problems presented by prong ring binder notebooks and spiral ring binder notebooks, and that is proportioned to have a low profile for facilitating carrying, storage, and general use.

Yet another principal object of the invention is to provide a notebook of the looseleaf binder type in which the binder device itself is of all plastic one piece construction that is essentially noiseless in being opened and closed, that permits the student user to readily remove and insert one or more sheets of the notebook paper for note taking and keeping purposes, and that is arranged to hold one or several sheets of the notebook paper on the outside surfacing of the notebook front panel or cover clipboard fashion for note taking purposes without requiring the conventional hold down clip or other comparable sheet hold down devices.

Still further objects of the invention are to provide a notebook arrangement that is especially suited for student use which employs upstanding rectilinear binder posts and a snap lock flap button down latching arrangement for each such post, for silent and convenient opening and closing of the binder to apply and remove notebook paper sheets for note taking and keeping purposes, to provide a notebook arrangement which regardless of whether the binder device is filled with the paper or contains only a few sheets of same, the notebook provides a low profile and without such sheets being crowded or bunched in the binder when the binder is filled, and to provide a notebook arrangement that is economical of manufacture, convenient to use with all types of prepunched paper of the type indicated, and that is especially well suited for student use in the taking and preserving class notes.

In accordance with the invention the notebook comprises a front panel, a spine or back panel, and a rear pannel, with the front and rear panels being respectively articulated to either side edge of the back panel. The binder device is of one piece all plastic construction that comprises a back piece that is suitably anchored to the inside surfacing of the rear panel along its inner edge that is articulated to the back panel. The binder back piece on its upwardly facing side has a pair of upstanding rectilinear posts disposed in spaced apart relation to receive, for instance, the uppermost and lowermost prepunched holes of the indicated commonly available type of notebook paper, with the back piece at its upper end also defining an upstanding end flange that has a flap articulated to its upstanding end for swinging in the plane of the back piece and its upstanding posts, and equipped with snap fit lock means for snap fit locking engagement with the free end of the upper binding post. Similarly, the back piece at its lower end defines a second upstanding end flange that has a flap articulated to the upstanding ends of same for swinging in the same plane, with the latter flap also having snap fit lock means for snap fit locking engagement with the free end of the lower back piece post.

When the indicated notebook paper is to be applied to the notebook arrangement in question, the front panel of the notebook is opened up to expose the binder device, and the indicated flaps are articulated to swing same from their snap fit locking engagement positions with the respective binder posts to oppositely and outwardly directed positions, to expose such posts, after which the notebook paper may be mounted in the notebook by reception of the respective posts in the similarly located upper and lower holes of the paper, after which the binder device and flaps are swung back to their snap fit locking relations with the respective binder posts to bind the notebook paper in the notebook, in which position the indicated binding flaps also overlie the paper bound in the notebook at the upper and lower margins of same. The paper so bound in the binder device is normally freed from its packaging, as the binder serves the function of holding the paper in place.

The notebook is moved to its closed relation by swinging the front panel flat against the notebook paper whereby the notebook presents a low profile for carrying, handling, and storage purposes, due to the proportioning of the binding posts, back piece end flanges, and notebook back panel to have essentially the same height, which height will accommodate a predetermined number range of the notebook sheets in the notebook in multiple sheet stack form, as for instance, one hundred twenty to one hundred forty of such sheets, depending on the paper weight involved in the sheets involved.

The front panel of the notebook on its outer surfacing adjacent the edge of same that is articulated to the spine forming back panel is formed to define a flat pocket extending substantially the height of the front panel for closely receiving the left hand margin of a sheet of the notebook paper, or several of such sheets, whereby a paper sheet margin holder is provided to mount the sheet or sheets on the front panel outer side surfacing for note taking clipboard fashion; the notebook front panel thus is to have a notebook paper margin holder capability. The indicated pocket is defined by a length of transparent vinyl stripping bonded to the front panel along the front panel edge that is articulated to the back panel and the front panel upper and lower edges whereby the pocket opening involved faces the notebook front panel free edge, which is normally at the right hand side of the notebook in its closed relation. Thus, a student for note taking purposes in a particular class may quickly remove one or several sheets of the notebook paper from the notebook and apply them, by insertion, to the front panel pocket, or margin holder, clipboard fashion, for note taking purposes, with a holding action on same being provided by the student briskly rubbing the vinyl against the paper whereby a static friction holding action on the paper along the margin holder is established, that adheres the top sheet to the vinyl. After the note taking for that particular class is completed, the student may readily remove the marked up sheets of paper involved and reapply them to the notebook binder, to be replaced by other notebook sheets, in a similar manner, for note taking in his next class.

Other objects, uses and advantages will be obvious or become apparent from a consideration of the application detailed specification and drawings in which like reference numerals are employed to indicate like parts throughout the several views.

In the drawings:

FIG. 1 is a frontal top perspective view of one embodiment of the invention shown in notebook closed relation with a group of the aforementioned prepunched notebook paper sheets contained therein, with one of the sheets shown applied to the top surfacing of the notebook front panel in frictional relation within the pocket defined by the notebook cover, clipboard fashion, for note taking purposes, and with the pocket forming stripping involved being shown broken away;

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

Figure 1:
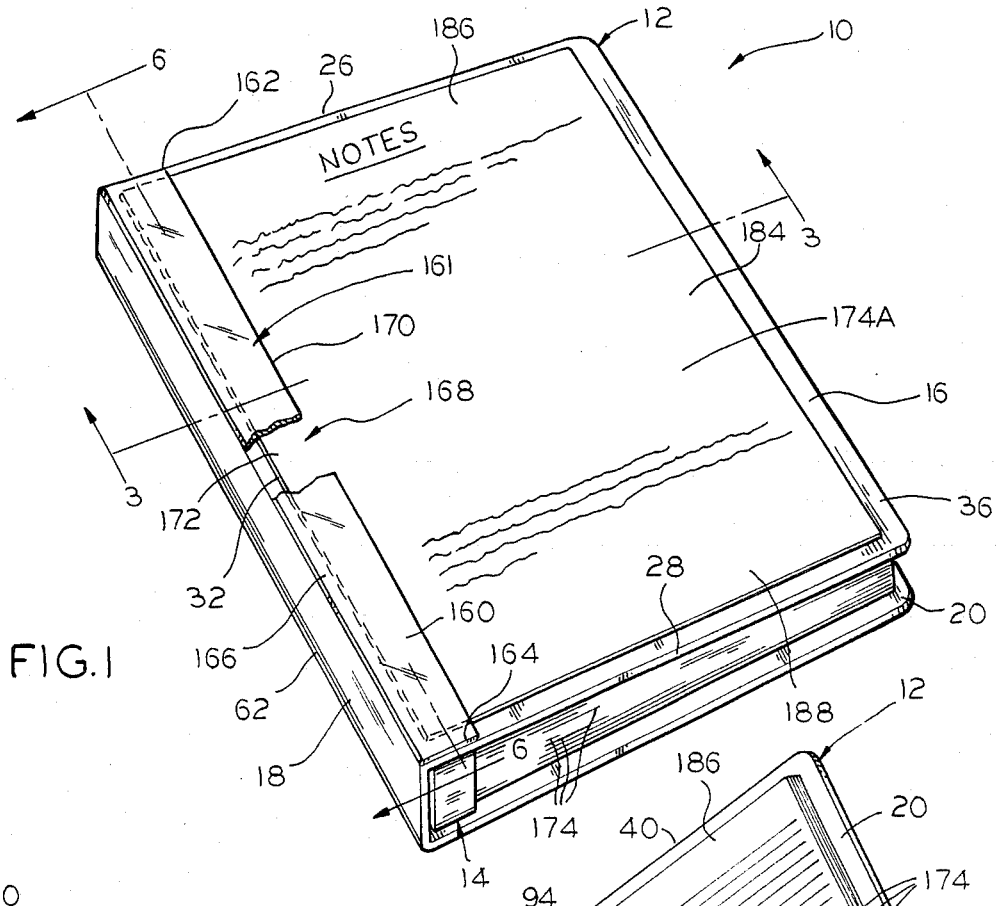
Figure 2:
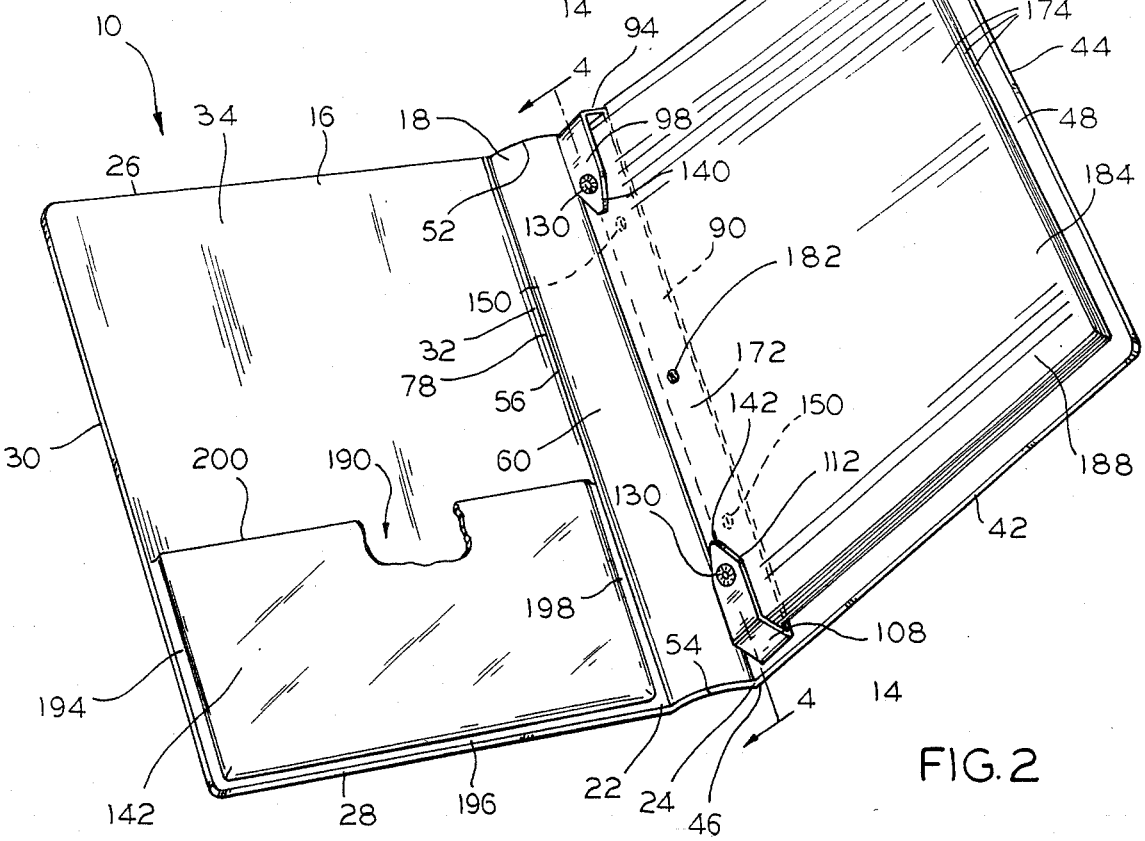
FIG. 2 is a view similar to that of FIG. 1, but with the front panel of the notebook cover swung to open position to expose the inside of the notebook, a quantity of notebook paper as bound in the notebook, and the paper binding device, with parts of same shown in phantom beneath the paper, and the inside pocket of the notebook cover that is partially broken away.

Reference numeral 10 of FIGS. 1 and 2 generally indicates a preferred embodiment of the notebook arrangement which comprises a cover 12 and a paper binder device 14.

The cover 12 comprises a front panel 16, a back panel 18, and a rear panel 20 that are of composite construction and connected together for hinging movement between open and closed positions about the respective hinging connections or articulations 22 and 24. The front panel 16 defines upper and lower side edges 26 and 28 that are in substantial parallelism, and free outer edge 30 and inner edge 32 that are in substantial parallelism, whereby the front panel 16 is of generally quadrilateral configuration.

The front panel 16 further defines inner side surfacing 34 and outer side surfacing 36.

The rear panel 32 defines upper and lower side edges 40 and 42 that are in substantial parallelism, free outer edge 44, and inner edge 46 (see FIGS. 2 and 3), whereby the rear panel 20 has a generally quadrilateral configuration that is similar to that of the front panel 16. The rear panel 32 also has inner surfacing 48 and outer surfacing 50.

The back panel 18 defines upper and lower end edges 52 and 54, and spaced side edges 56 and 58 that are respectively connected to the front and rear panel inner edges 32 and 46. The back cover defines inner surfacing 60 and outer surfacing 62.

In the illustrated embodiment of the invention, the panels of the cover 12 are of composite arrangement with the front, back and rear panels having the respective cores 70, 72, and 74, with the cores 70, 72 and 74 having applied across their inner and outer surfacings and about their side and end edges a suitable sheathing 76 which sheaths or covers the respective cores 70, 72 and 74, and is continuous across the articulations 22 and 24 to form the cover flexing joints or articulations 78 and 80 that define substantially parallel swinging axes for swinging the front panel 16 relative to the back panel 18, and for swinging the rear panel 20 relative to the back panel 18.

The sheathing 76 in accordance with standard practices for making covers of the type indicated may be of any suitable type such as a finishing covering of fabric leather, plastic sheeting, or the like, to define for the cover panels indicated the respective inner and outer surfacings of the panels. Various manners of securing the sheathing 76 to the respective cores 70, 72 and 74 may be employed, as will be apparent to those skilled in this art, though for manufacturing expediency and economy, it is preferred to use adhesive since the joinder between the sheathing materials and the cores may be affected by passing the same through suitable pressure applying rollers, thus smoothly and evenly disposing the sheathing material over and in suitable adhesive bonding relation with the respective panel cores.

The cover 12 may thus be formed in accordance with any of the well known manners in this art, and thus may be of electron heat seal, case made, or cut flush constructions, or it may be of a conventional one piece construction formed from a suitable plastic material, such as polyethylene.

The binder device 14 in its preferred form is of molded one piece plastic construction, and preferably is formed from polyethylene by a suitable injection molding procedure.

Figure 4:
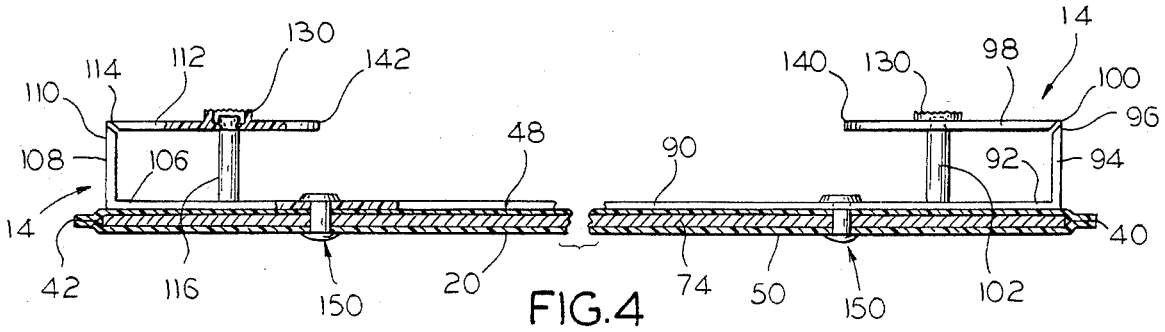
FIG. 4 is a cross-sectional view through the vertical height of the notebook and through the notebook paper binding device, taken substantially along line 4—4 of FIG. 2, with parts broken away, and the binder device being shown in its closed, notebook paper binding relation.
Figure 5:
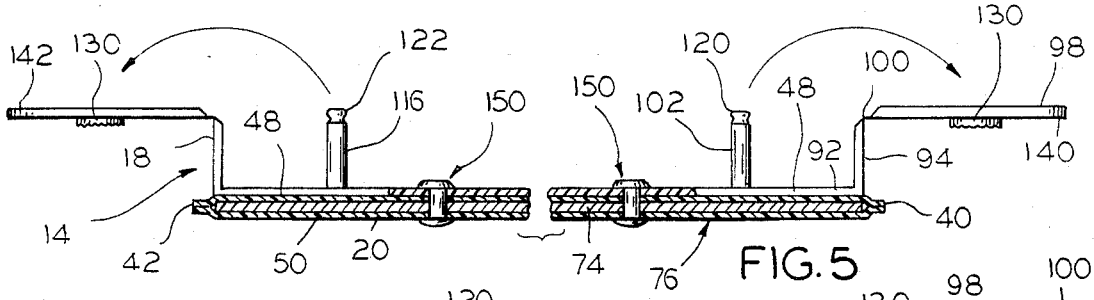
FIG. 5 is similar to that of FIG. 4, but shows the binder device in its open, paper releasing relation.

The binder device 14 is best shown in FIGS. 2, 4 and 5, and comprises an elongate back piece strip or portion 90 having at its upper end 92 an upstanding end wall or flange portion 94 which is integral at its upstanding end 96 with a flap 98 that is hinged at articulation 100 to swing between the positions shown in FIGS. 4 and 5 with respect to a binder post or stud 102 that is integral with the back piece or portion 90 and spaced from the back piece or portion end flange portion 94. The post or stud 102 is of rectilinear configuration and is in upstanding relation to back piece 90.

Similarly, the back piece or portion 90 adjacent its lower end 106 defines upstanding end flange or wall portion 108 that at its upper end 110 is integral with flap portion 112 which flexes about articulation 114 between the positions of FIGS. 4 and 5 relative to a second post or stud 116 that is integral with the back piece or portion 90, and is identical to post or stud 102.

Articulations 100 and 114 are preferably of the type offered by Eastman Chemical Products, Inc., Kingsport, Tenn. under its trademark Living Hinge; but any articulation arrangement of a one-piece character that provides the indicated 180 degree swinging action without breaking of the articulation will be satisfactory.

The posts or studs 102 and 116 are spaced apart to have a spacing between them that is identical to the upper and lower prepunched holes of three ring binder notebook paper (eight and one-half inches). The posts or studs 102 and 116 are symetrically located on the back piece or portion 90 along its longitudinal mid portion (see FIG. 3), and they are respectively formed with identical rounded or spherically contoured locking end portions 120 and 122. The binder flap 98 includes in the mid portion of same a snap fit washer portion 130 defining a snap fit socket 132 (see FIG. 7) which resiliently receives the rounded recessed head portion 120 of the post or stud 102, through reduced aperture 134, defined by annular flange 135, to hold the flap 98 in its paper binding relation of FIG. 4. The binder flap 112 at the lower end of the binder device has a similar snap fit washer portion 130 also formed in the manner indicated in FIG. 7 for snap fit latching of the flap 112 to the rounded recessed head 122 of the post or stud 116. The flap 98 extends beyond its washer portion 130 to define handle portion 140 while the flap 112 is formed with a similar handle portion 142. Washer portions 130 are serrated as at 131 for good frictional characteristics.

Figure 3:
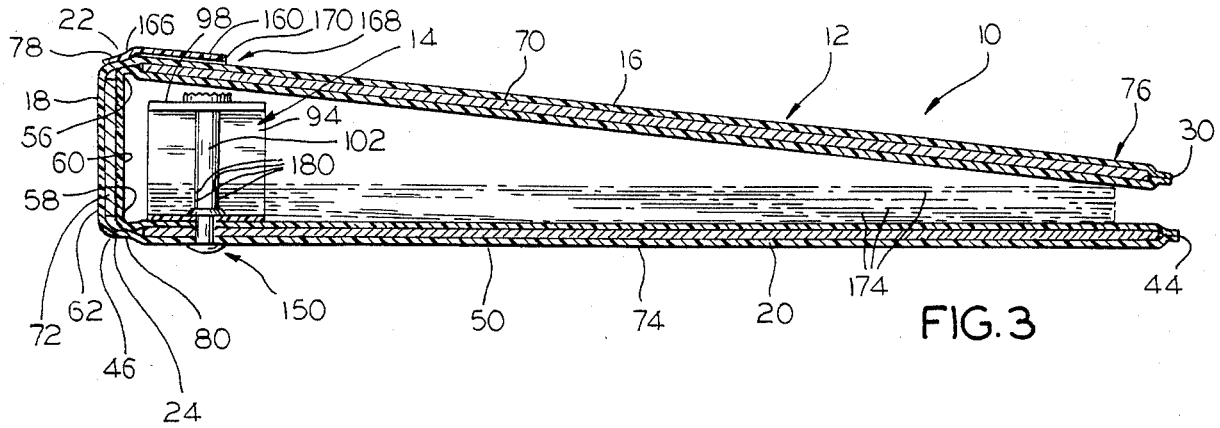
FIG. 3 is a transverse cross-sectional view through the notebook taken substantially along line 3—3 of FIG. 1, with parts broken away.

The back piece or portion 90 of the binder device is anchored to the cover 12 by suitably spaced rivets 150 of any suitable type of construction and application which pass through the back piece or portion 90, the sheathing 76, and the rear cover core 74 to unite these parts together in the manner diagrammatically illustrated in FIGS. 3–5 and thus inwardly of but adjacent the respective posts 102 and 106. The binder device 14 is located on the rear panel inside surfacing 48 adjacent the inner edge 46 of the rear panel 20 and in substantial parallelism with the articulation 24, and with the posts or studs 102 and 116 appropriately centered between the upper and lower edges 40 and 42 of the rear panel, as indicated in the drawings. No post or stud comparable to the posts or studs 102 and 116 is provided for the center hole of the prepunched three hole notebook paper that is so commonly available to students for application to their three ring binder notebooks, as none is required. Similarly, for binding other types of prepunched paper with additional prepunched apertures formed in same for application for other types of binders formed with more than three binding rings or the like, only the two posts or studs 102 and 116 illustrated are required in accordance with the present invention.

Further in accordance with the invention, the outside surfacing 36 of the front panel 16 has a paper margin holder 161; thus, panel 16 has secured across the inner or left hand edge 32 of the surfacing 36 of the front panel a strip 160 of plastic material, such as vinyl, which may be transparent and is is applied to the sheathing 76 in heat welded relation thereto, as at 162 and 164 along the upper and lower edges 26 and 28 of the front panel, and at 166 along the inner edge 32 of the front panel, to define a flat pocket 168 that is open along the side edge 170 of the stripping 160 to receive the left hand marginal edge portion 172 of a sheet 174A of the notebook paper in question. As indicated in FIG. 1 wherein this feature of the invention is best illustrated, margin holder 161 mounts the notebook paper sheet 174A clipboard fashion on the outer surfacing 36 of the front cover in good position for note taking by the student.

The notebook paper sheet 174A illustrated in FIG. 1 and the pads or packages of same in which such notebook paper is furnished by distributors are entirely conventional and in the form illustrated, the sheets 174 and 174A are identically prepunched to define the apertures 180 that are to receive the mounting posts or studs 102 and 116 of the binder device 14, and a centrally located aperture 182 that is ignored for purposes of the present invention, which is normally provided to receive the central ring binder of three ring binder notebooks. Each such standard three hole sheet 174 includes in addition to the left hand marginal portion 172 that is indicated in FIG. 1, a right hand marginal portion 184, an upper marginal portion 186, and a lower marginal portion 188. As is conventional, the sheets 174 and 174A are quadrilateral in configuration, and the notebook cover front and rear panels 16 and 20 are appropriately of similar quadrilateral configuration to overlie and cover the stack of sheets 174 contained within the notebook 10 when the notebook 10 is closed. The sheets 174 and 174A if lined or ruled usually have the left margin 172 delineated by one or several vertical marginal lines (not shown) running the height of the paper sheet involved. Sheet 174A is one of the sheets 174 that has been applied as indicated to the outer surfacing 36 of the front panel 16 for note taking purposes, and thus is identical to sheets 174.

The notebook paper in question may be applied to the notebook 10 by laying the notebook 10 on a flat supporting surface, such as a desk or the like, with the rear panel 10 lying on such surface, and then opening the front panel as indicated in FIG. 2 to expose the binder device 14. The flap portions 98 and 112 of the binder back piece or portion 90 are swung from their closed positions of FIG. 4 to their open positions of FIG. 5 to expose the binding posts 102 and 116 for application of the indicated type of paper to the binder. Preferably the binder posts or studs 102 and 116 are proportioned to accept a desired amount of such paper, which may be just a few sheets, or one or up to 120–140 of such sheets, depending on the paper weight (and thus the thickness of the sheets employed). It is preferred that the binder device end walls or flanges 94 and 108, and the width dimension of the back panel 18, be of similar proportions so that the cover when the binder fully filled with such paper, in its closed relation to the paper in the binder has the low profile indicated in FIG. 1, with the front and rear panels 16 and 20 approximately in parallel relation. In the showing of FIG. 3 the notebook is illustrated as being only partially filled with the sheets 174, with the proportioning of the posts or studs 102 and 116 and related components being to accommodate up to about 120 sheets 174 of the type normally offered students by discount houses and the like. The low profile of notebook 10 remains due to the reduced sizing needed for the binder device 14 in accordance with the invention.

Figure 7:
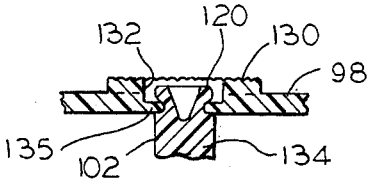
FIG. 7 is a fragmental cross-sectional view diagrammatically of the manner in which the binder sets of flaps and posts cooperate snap fit lock fashion to bind the paper in the notebrook.
Figure 8:
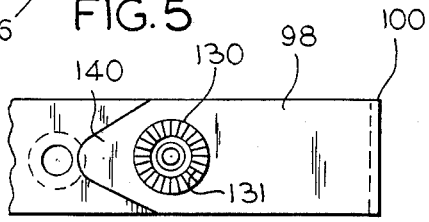
FIG. 8 is a fragmental plan view of the binder upper flap and associated parts, as shown in FIG. 4.
Figure 6:
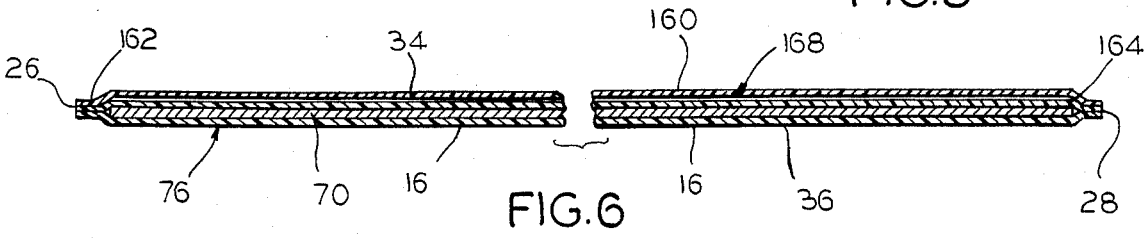
FIG. 6 is a cross-sectional view through the notebook front panel and its associated exterior pocket, taken substantially along line 6—6 of FIG. 1, with the sheet of notebook paper that is shown in FIG. 1 mounted in such pocket omitted.

In any event, with the notebook cover opened in the manner indicated to expose the paper binding posts 102 and 116, the binder back piece flaps 98 and 112 are disposed to extend exteriorily of the notebook, as indicated in FIG. 5, and the notebook paper is applied directly to the posts or studs 102 and 116, after which the respective flaps 98 and 112 are returned to their positions of FIG. 4, with the snap fit washer locking portions 130 being pressed into snap fit locking relation with the respective post or stud locking heads 120 and 122. The handle portions 140 and 142 of the respective flaps 98 and 112 facilitate handling of the respective flap portions 98 and 112 for movement between the positions indicated in FIGS. 4 and 5, with the washer portions 130 of the respective flap portions being pressed downwardly against the respective posts or studs 102 and 116 to achieve the snap fit locking relation that is represented by the showing of FIG. 7. In the snap fit locking relation that is there illustrated, the aperture 134 of the locking recess 132 is cammed radially outwardly about the respective heads 120 and 122 as the washer portions 130 are pressed downwardly to snap the respective heads 120 and 122 into the respective washer snap fit locking portions, and removal of the flaps 98 and 112 from snap fit locking relation with the respective post heads 120 and 122 is effected in the same manner by moving the flaps in the opposite direction. The serrating 131 of washer portions 130 insures against finger slipping when the respective flaps 98 and 112 are returned to their locking relations with the respective studs.

With the binder device flaps 98 and 112 returned to their positioning shown in FIG. 4 to close the posts or studs 102 and 116 against removal from the paper therefrom, the notebook paper is mounted looseleaf fashion in the notebook 10, and the front cover panel 16 then may be swung to the position of FIGS. 1 and 3 to close the notebook, for carrying, or storage purposes, or the like. In this relation of the notebook components, the notebook presents a low profile for ease of carrying and storing since it will lie flat whether it is partially or wholly filled with the sheets 174, and it has no outstanding or upstanding or outstanding parts that will catch on things, such as clothing, or will prevent it from lying flat. As so closed the notebook 10 is well suited for carrying in knapsacks or other backpacks and the like that are commonly used by students to carry books to class.

When the notebook is to be used for note taking purposes, the student can open same up, unfasten the binder device to the position of FIG. 5, and withdraw one or several sheets 174 and mount them in the margin holder pocket 168 under stripping 160, which disposes such sheet or sheets 174A clipboard fashion for note taking purposes. The student by pressing a finger or thumb against the stripping 160 and drawing the digit longitudinally of the front panel edging 32, so as to press the stripping 160 against the top sheet 174A of notebook paper with a rubbing action, establishes a frictional relationship between the stripping 160 and notebook paper sheet 174A that opposes withdrawal of the top sheet 174A from its mounted relation in the pocket 168. With the notebook 10 in its closed relation (as indicated in FIG. 1), the student may take notes in a particular class, by writing same on the sheet or sheets 174A as needed, and after the note taking is completed, the marked up sheets 174A may be withdrawn from the pocket 168 and returned to the stack of sheets contained within the binder device with one or more additional blank sheets of notebook paper being withdrawn and applied to the pocket 168 for further note taking purposes as needed.

It is also preferred that the inside surfacings 34 and 48 of the front and rear panels be provided with pockets to receive hand out paper materials, one of such pockets being illustrated in FIG. 2 at 190, which comprises a sheet of vinyl stripping 192 or the like applied across the lower portion at the inside surfacing 34 of the front panel 16 and heat welded thereto as at 194, 196, 198, along the front panel free edge 30, lower edge 28, and inside edge 32, whereby access to the pocket 190 is under the unattached edging 200 of the stripping 192.

When the user of the notebook 10 returns to his place of residence (or other place of study after class, his notebook will have bound in same the notes he has taken during the various classes he has attended during the day on the marked up sheets that are bound within the binder device 14, as well as the hand out materials that are applied to the notebook inside pockets that are illustrated by the pocket 190. The student may then open up the notebook 10 and appropriately organize his notes and hand out materials for analysis and further study, and storage as needed. The notebook 10 itself and its binder device 14 may be reused as needed during the school year to accept fresh notebook sheets as may need to be applied to the notebook, whether singly or in stack or pad form, as they are available at places dispensing school supplies, contrary to the limited use of spiral wire binders.

It will therefore be seen that the invention provides a low profile notebook that is specifically adapted for accepting the common prepunched notebook paper (lined or blank) that is so widely used by students at all levels of education today. The opening and closing of the binder device 14 to apply and remove notebook paper to the notebook, whether in package form or in single sheet form, is easy and essentially silent as the binder device is of all plastic construction with the opening and closing off of the binder posts or studs being effected essentially silently. This is to be distinguished from the noisy ring binders that are to be found in metallic metals commonly used in three ring binder notebooks and the like, which are arranged to place the ring prongs of each set of ring binders under bias when the rings are opened and the prong sections of each ring set snapped together with a very audible noise when the binder is returned to closed relation.

When the binder device of the present invention is opened up, the flaps 98 and 112 extend outwardly of the cover 12 so that should the front cover be closed over the paper without first returning the flaps 98 and 112 to their closed relations of FIG. 4, the user of the notebook will be warned that the binder device is not in closed relation against the notebook sheets.

The notebook 10 when the binder is filled to its capacity represented by the height of the binder posts 102 and 116 is of low profile configuration with the front and rear covers in substantially parallel relation and is thus easy to carry, use, store, and the like. The binder will readily fit into the various forms of backpack carrying implements that are commonly employed by students at the present time.

With the binder posts 102 and 116 spaced as indicated, the binder will accept the common eight and one-half by eleven inch paper as well as eight by ten inch paper, the latter being commonly used for grammar school work. Obviously binders of other proportions may be made to accommodate other commonly used paper, such as the nine and one-half by six inch paper commonly used for university and business use, and the eight and one-half by thirteen inch paper commonly used for legal purposes. Special notebooks arranged in accordance with the principles of the present invention may be devised for holding computer read outs and other special paper and similar sheeting having prepunched binding aperture relationships.

The binder arrangement of this invention may also be employed in connection with the commonly available trifold type binder, in which the cover 12 includes an organizer panel hinged to the outer edge 44 of rear panel 32, that is received under front panel 16 in the folded or closed relation of the notebook, with the organizer panel including pocketing of the type suggested for the inside surfacings 34 and 48 of the front and rear panels.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. A notebook especially suited for student classroom note taking use and arranged for removably receiving and holding, looseleaf style, prepunched notebook paper in multiple sheet stack form, of which the sheets of the stack are of identical quadrilateral shape in accordance with a predetermined notebook paper dimensioning, and the binder holes of the paper stack are aligned and formed in spaced apart relation adjacent the left hand margin of the front side of the paper, for binding purposes, in accordance with a predetermined notebook paper dimensioning, said notebook comprising:

a front panel and a rear panel, said panels each being quadrilateral in configuration and of substantially equal size, and proportioned to overlie, notebook fashion, the paper stack when the stack is held by the notebook, with each said panel defining parallel upper and lower side edges along either side of same, inner edges that are in adjacency, and outer free edges, with said inner and outer edges being disposed generally normally of the respective panel side edges, a back panel intermediate said front and rear panels and articulated to the front panel along said inner edge of same and articulated to the rear panel along said inner edge of same, said panels further each defining inner and outer side surfacings, and a notebook paper binder device secured to the rear panel adjacent and along said inner edge of same for removably binding the notebook paper stack in the notebook, said binder device comprising:

a rectilinear back strip substantially paralleling said inner edge of said rear panel and secured to said rear panel on said inner side surfacing of same, said back strip having upper and lower ends respectively disposed adjacent the rear panel respective upper and lower side edges, said back strip further having a first rectilinear post in upstanding relation thereto and adjacent to but spaced from said upper end thereof, and a second rectilinear post in upstanding relation thereto and adjacent to but spaced from said lower end thereof, said posts having a spacing from each other and being located on said strip for separate reception in two of the prepunched holes of the notebook paper stack to locate and position the paper stack within the margins of the rear panel inner side surfacing when the paper stack is applied to said posts, said posts each defining an upstanding free end, said back strip upper end defining an end flange in upstanding relation thereto and having a flap articulated to the upstanding end of same for swinging between locked and unlocked positions relative to said first post in a plane that is substantially coplanar with the longitudinal dimension of said strip, with said flap thereof having a free end and snap fit lock means disposed for finger pressure induced snap fit locking engagement with and unlocking from said free end of said first post, said back strip lower end defining an end flange in upstanding relation thereto and having a flap articulated to the upstanding end of same for swinging between locked and unlocked positions relative to said second post in said plane, with said flap thereof having a free end and snap fit lock means disposed for finger pressure induced snap fit locking engagement with and unlocking from said free end of said second post, said panels being articulated together for closure of said front panel over said binder device and said rear panel in the notebook closed relation, wherein said binder device is enclosed within the notebook, and for opening of said front panel away from said rear panel for exposure of expose said binder device in the notebook open relation, said back strip end flanges and said posts being in substantial parallelism and being similarly proportioned, normally of said back strip, to dispose said free ends of said flaps, respectively, above and below, respectively, said rear panel upper and lower edges when said flaps are articulated approximately one hundred eighty degrees in opposite directions away from their respective locked positions when said notebook panels are articulated to said notebook open relation, whereby when said notebook panels are articulated to dispose the notebook in its said open relation, said binder device and flaps thereof are exposed and said flaps may be articulated to oppositely swing same in said plane from their snap fit locking engagement with the respective posts to dispose said flaps in their respective oppositely directed relations, to expose said posts for application of the notebook paper thereto, the notebook paper may be mounted in said notebook by reception of said posts in the similarly located binder holes of the paper, after which said flaps are swung in said plane back to, and are finger pressure biased into, their respective snap fit locking engagements with the respective posts to bind the notebook paper in the notebook, in which position said flaps overlie the paper bound in the notebook at the upper and lower margins of same, and on articulation of said Panels to dispose the notebook in its closed relation, said front panel overlies said binder device including said flaps thereof, and said binder device is enclosed within the notebook, and should said notebook panels be articulated to dispose the notebook in its closed relation with said flaps disposed in their said oppositely directed relations, said free ends of said flaps are exposed exteriorly of the notebook to visually alert the user that said flaps are displaced from said locking engagement thereof with the said posts, respectively.

2. The notebook set forth in claim 1 wherein:

said back strip posts and end flanges are proportioned, and said panels are proportioned, such that when said front panel is articulated to close the notebook on the paper stack bound in said binder device, said notebook presents a low profile.

3. The notebook set forth in claim 1 wherein:

said back strip, and said posts, said end flanges, and said flaps thereof are of one piece plastic construction.

4. The notebook set forth in claim 1 wherein:

said front panel on said outer surfacing thereof adjacent said inner edge thereof has a flat pocket extending substantially the length of said inner edge thereof for receiving the left hand margin of one or more sheets of the paper stack to mount same on said front panel outer side surfacing clipboard fashion for note taking purposes, said binder device serving to releasably hold in the notebook the paper stack from which the paper sheets to be mounted on said front panel surface in said clipboard fashion are selectively removed by the notebook user.

5. The notebook set forth in claim 4 wherein:

said pocket is formed by a length of stripping bonded to said front panel along said front panel inner edge and said front panel upper and lower edges whereby said pocket opening faces said front panel free edge, said stripping being in close fitting relation to said outer side surfacing of said front panel.

6. The notebook set forth in claim 5 wherein:

said stripping is transparent.

* * * * *